United States Patent [19]

Brassfield

[11] 4,322,897

[45] Apr. 6, 1982

[54] AIRLIFT TYPE DREDGING APPARATUS

[76] Inventor: Robert W. Brassfield, 144 Hayes Ave., Ventura, Calif. 93003

[21] Appl. No.: 188,685

[22] Filed: Sep. 19, 1980

[51] Int. Cl.[3] ..... E02F 3/88

[52] U.S. Cl. ..... 37/62; 417/179; 417/197

[58] Field of Search ..... 417/179, 197; 37/61, 37/62

[56] References Cited

U.S. PATENT DOCUMENTS

| | | | |
|---|---|---|---|
| 105,056 | 7/1870 | Eads | 37/61 |
| 628,187 | 7/1899 | Sibley | 417/197 |
| 857,768 | 6/1907 | Stirling | 417/197 |
| 2,361,861 | 10/1944 | Masowich | 417/197 |
| 2,786,651 | 3/1957 | Mickle | 417/179 X |
| 3,153,290 | 10/1964 | Saito | 37/62 |
| 3,855,367 | 12/1974 | Webb | 405/52 X |

*Primary Examiner*—Clifford D. Crowder

*Attorney, Agent, or Firm*—Ralph B. Pastoriza

[57] ABSTRACT

The dredging apparatus includes a vertical hollow body arranged to be lowered to the ocean floor and incorporating a venturi entrance at a bottom opening converging to a throat and thence widening abruptly to define an annular step facing upwardly. The diffusion portion of the venturi extends from the step to the upper part of the body and is defined by a gradually widening or increasing diameter portion. Compressed air or gas is introduced into the throat of the venturi at the annular step by passing the gas through a series of vertical holes or orifices passing through the step. The step results in cavitation of the flow of fluid and debris past the exit end of the throat at the step area to result in a reduced pressure at the step surface to thereby facilitate the flow of gas upwardly through the step. The fluid and debris are passed up to the surface of the ocean by an appropriate conveying means either in the form of flexible hose or a series of pipe sections.

5 Claims, 6 Drawing Figures

AIRLIFT TYPE DREDGING APPARATUS

This invention relates generally to dredging devices and more particularly to an improved airlift type dredging apparatus for use in deep ocean dredging operations.

BACKGROUND OF THE INVENTION

Many known types of dredging apparatus as well as anti-siltation systems utilize bodies incorporating venturi structures with a compressed gas or air introduced into the venturi to aid in "lifting" fluid and debris from the ocean floor or in the case of silt deposits to pick up the silt and redistribute it through the water.

As an example of the foregoing, reference is had to U.S. Pat. No. 3,855,367 to Webb which, while relating to a venturi type anti-siltation system, could, in a broad sense, be used for dredging. In the Webb structure, the diffuser portion of the venturi is fairly shallow and the walls form a relatively large angle with the vertical. The compressed gas or air for providing "lift" is introduced midway in this diffuser portion of the venturi and while the action is sufficient for anti-siltation problems in most instances, the arrangement illustrated is not well suited for deep ocean dredging operations. More particularly, it is found that a "sudden release" of the liquid sucked up through the venturi occurs at the diffuser portion and this "sudden release" is not desirable because it inhibits the flow of incoming fluid. If this diffuser portion of the venturi in the Webb patent were flared outwardly at a very gradual angle, no sudden release of the incoming fluid would occur and such would be an ideal situation were it not for the fact that the incoming air would flow directly into the fluid and thus experience some pressure resistance.

U.S. Pat. No. 2,361,861 issued to Masowich is concerned with a venturi arrangement for the removal of welding fumes and while this particular application is far afield from deep sea dredging operations, the structure disclosed merits careful consideration since many of the air lift principles are utilized. In the Masowich patent, the compressed air or gas is introduced through a continuous annulus at the throat of the venturi section through a plenum chamber. This type of continuous circular entry pattern results in the formation of large bubbles in the liquid passing up through the venturi. Such large bubbles tend to slip upwardly through the liquid and do not reduce the overall pressure of the liquid sufficiently. While the continuous open circular pattern for the compressed gas or air is not an appreciable problem where welding fumes are to be drawn upwardly, such a structure could introduce problems in deep sea dredging operations. For example, it would be difficult to empty the plenum chamber of any excess liquid if the air or gas flowed into the venturi pipe in a continuous circular pattern. If the apparatus vibrates or rocks back and forth while in use, the excess liquid would restrict at various alternating points the air or gas from flowing into the vertical pipe forming the continuation of the venturi.

From the foregoing, it can be appreciated that while basic venturi structures with the introduction of compressed gas or air are known, there still is a need for an improved structure of the air lift type suitable for deep sea dredging operations which can operate more efficiently than available equipment.

BRIEF DESCRIPTION OF THE PRESENT INVENTION

With the foregoing considerations in mind, the present invention contemplates the provision of a greatly improved dredging apparatus wherein the same is well suited for deep ocean dredging such as the dredging of manganese nodules and wherein the same dredging efficiency presently available in known devices can be achieved for substantially less energy expenditure.

In essence, the present invention provides a venturi structure wherein a cavitation phenomenon is established at the throat of the venturi to result in a reduced pressure area which aids greatly in the maintenance of the compressed gas or air flow into the throat area of the venturi thereby resulting in a greatly increased efficiency in the conveying of fluid and debris to the surface of the ocean. This cavitation is established by the provision of an annular horizontal step at the exit end of the throat of the venturi in combination with the interior wall extending upwardly from the step gradually increasing in internal diameter to define a venturi diffuser. The compressed gas or air itself is introduced through a plurality of small orifices or holes extending vertically through the annular step so as to be introduced directly into the cavitation area.

As a consequence of the foregoing, less energy is required in the provision of the compressed air or gas to the venturi and in the raising of fluid and debris to the surface than is possible with presently known devices.

BRIEF DESCRIPTION OF THE DRAWINGS

A better understanding of this invention as well as further features and advantages thereof will be had by now referring to the accompanying drawings in which.

DETAILED DESCRIPTION OF

Figure 1:
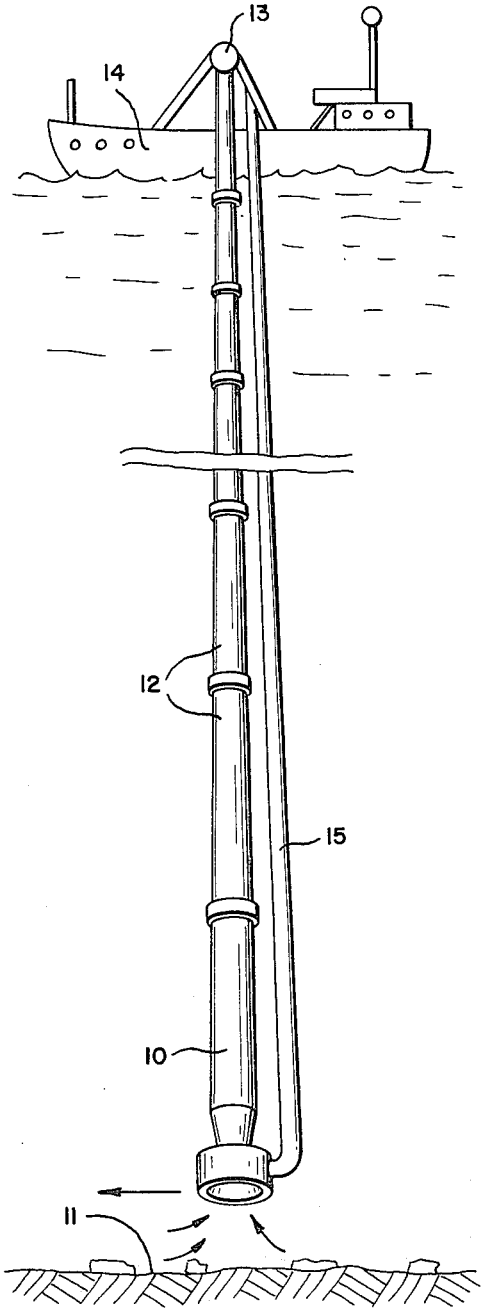
FIG. 1 is a highly schematic illustration of the dredging apparatus of this invention in operation from a ship at the surface of the ocean.

Referring first to FIG. 1, the dredging apparatus includes a generally vertically oriented elongated hollow body 10. Body 10 has a lower opening positioned close to the ocean floor 11 and an upper opening connecting to a series of pipes or tubes 12 for conveying dredged material up to the surface of the ocean.

As shown in the upper portion of FIG. 1, the pipe string 12 is operated from an appropriate derrick symbolically illustrated at 13 carried by ship 14. An appropriate source of compressed air or gas is carried on the ship 14 and arranged to be passed down a gas line 15 to the dredging apparatus 10.

Figure 2:
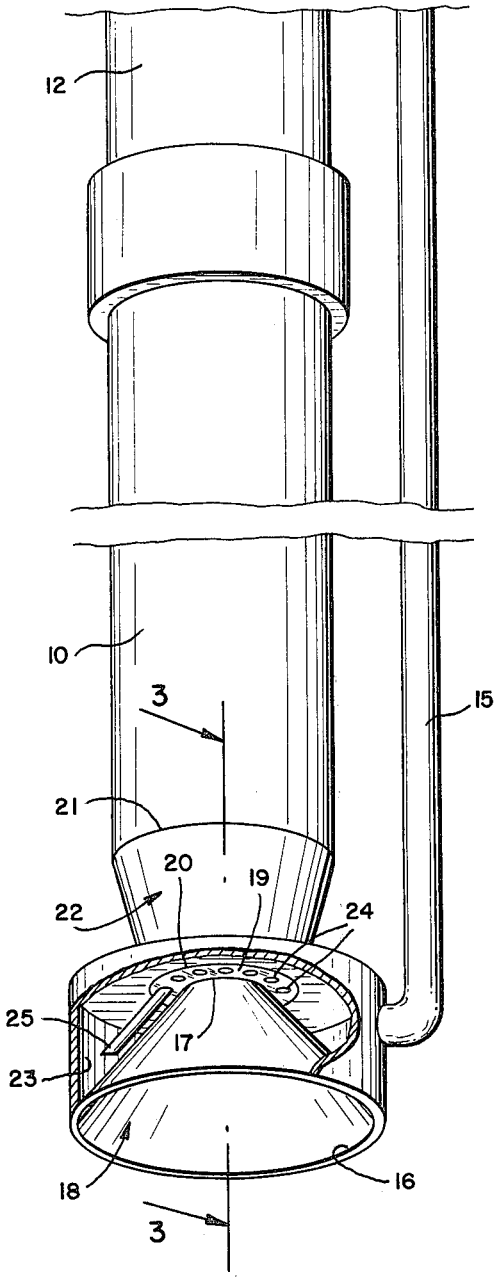
FIG. 2 is a greatly enlarged broken away perspective view of the dredging apparatus itself illustrated in FIG. 1.

Referring to the enlarged view of FIG. 2, the referred to lower opening of the body 10 is shown at 16 and is of a first given internal diameter decreasing in upward direction to terminate in a throat opening 17 of a second given internal diameter. The converging internal wall defines a venturi entrance designated generally by the arrow 18.

The throat opening 17 immediately increases in diameter at its exit end to a third given internal diameter to define an upwardly facing horizontal annular step 19 lying in a plane normal to the vertical. The interior wall of the body 10 extending upwardly from the outer edge of the step as at 20 gradually increases in internal diameter to an upper opening of a fourth given internal diameter indicated at 21 to define a venturi diffuser.

Figure 3:
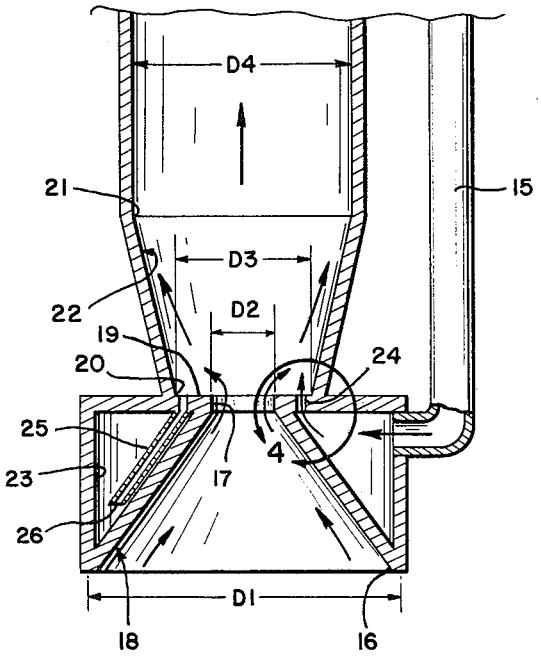
FIG. 3 is a fragmentary cross section taken in the direction of the arrows 3—3 of FIG. 2.

All of the foregoing can better be seen in the cross section of FIG. 3 wherein the first, second, third and fourth internal diameters are designated by the symbols D1, D2, D3, and D4 respectively.

In the specific embodiment shown in both FIGS. 2 and 3, the gas line 15 constitutes part of a means for introducing a flow of gas upwardly through the annular step 19 from the exterior of the venturi entrance to the venturi diffuser to draw into the lower opening and venturi entrance fluid and debris from the ocean floor. For this purpose, there is provided a plenum chamber indicated at 23 surrounding the lower portion of the body 10 defining the venturi entrance 18 connected to the gas line 15. The annular step 19, in turn, is provided with a plurality of vertical holes 24 passing normally therethrough to communicate with the plenum chamber so that gas flow from the gas line 15 is directed vertically upwardly through the top surface of the step and thence into the venturi diffuser.

The flow of fluid and debris from the ocean floor up into the venturi entrance and through the venturi throat to the diffuser is indicated by the arrows in FIG. 3 and in accord with the essence of the present invention, there is caused to be generated by the step cavitation in the flow of the fluid and debris past the exit ends of the throat at the step area. This cavitation results in a reduced pressure at the step surface to facilitate the flow of gas upwardly through the step, the fluid and debris passing up the conveying means in the form of the connected tubes or pipes shown in FIG. 1.

As noted above, the cavitation of the flowing fluid at the exit end of the venturi throat is caused by the abrupt increase in the throat diameter from D2 to D3 defining the horizontal annular step. This step in combination with the gradually outwardly sloping walls between the diameters D3 and D4 defining the venturi diffuser results in a very efficient transfer of the fluid and debris upwardly through the conveying means to the surface of the ocean. There is no "sudden release" of the fluid at the venturi diffuser because of this gradual sloping of the walls. Yet, there is provided a desirable hydraulic flow because of the slight divergence that is involved. The reduced pressure resulting from the cavitation at the surface of the step, as stated, aids greatly in drawing in the fluid and thus permits deep ocean dredging operations to be carried out with substantially less energy in the provision of the compressed air or gas to the throat of the venturi.

In order that the foregoing described results are realized, not only must the angles of the venturi entrance walls with the vertical and the diffuser diverging walls with the vertical and the various diameters D1 through D4 fall within certain ranges, but there must also exist a proper relationship between the cross sectional area of the gas inlet pipe 15 into the plenum chamber and the total of the cross sectional areas of the various vertical holes 24 passing through the step. Taking the throat diameter D2 as a reference, the remaining diameters are related thereto in accord with these ranges as follows:

$2.0D2 \leqq D1 \leqq 2.5D2$ $1.1D2 \leqq D3 \leqq 1.2D2$ $1.4D2 \leqq D4 \leqq 1.6D2.$ Also, the angle of the entrance wall of the venturi designated $\alpha$ in FIG. 4 and the angle of the diffuser wall with the vertical indicated $\beta$ are in the range indicated as follows:

$25° \leqq \alpha \leqq 35°$ $5° \leqq \beta \leqq 11°$

Finally, the cross sectional area of the gas line 15 is made at least equal to the total of the individual cross sectional areas of the various holes 24 so that there is experienced a minimum of impedance to the gas flow from the gas line through the holes into the diffuser portion of the venturi.

Figure 4:
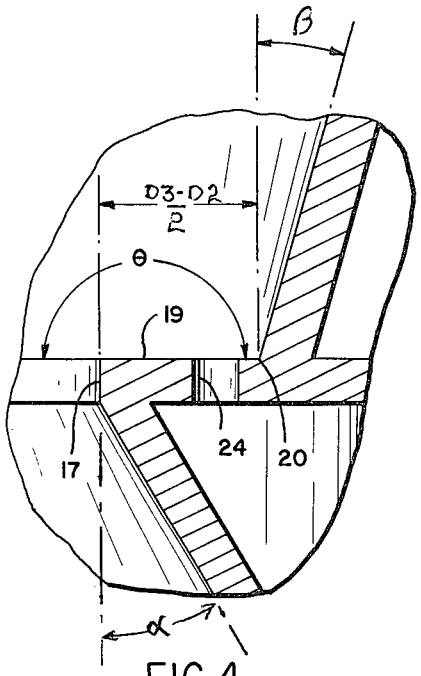
FIG. 4 is a greatly enlarged fragmentary cross section of that portion of the apparatus of FIG. 3 enclosed within the circular arrow 4.

With specific reference to FIG. 4, it will be noted that each of the holes such as 24 is directed vertically through the step 19. The provision of a plurality of such holes assures a vertical flow of the fluid from the plenum chamber into the cavitation area as opposed to swirling flow which might result were there provided a continuously open annular area through which the air from the chamber passed. In other words, the plurality of holes serves to "straighten" the air flow into the cavitation area.

As mentioned, the abrupt increase from the diameter D2 to the diameter D3 defines the horizontal annular step 19 and in this respect, it is important that the plane of the step 19 be normal to the vertical axis and include the exit opening of the throat 17. In FIG. 4, the angle $\theta$ will thus be exactly 180°. The width of the step, of course, the formula D3-D2/2.

In an actual embodiment of the present invention, as described in FIGS. 2, 3 and 4 the throat diameter D2 might typically be eight inches, the lower opening diameter D1 eighteen inches, the diameter D3 in the area of nine to nine and a half inches and the diameter D4 twelve inches. The angle $\alpha$ in FIG. 4 would be 30° and the angle $\beta$8°.

In the specific embodiment of FIGS. 2 and 3 wherein there is provided the plenum chamber 23, it can occur that the same will become filled with liquid as a consequence of slight swaying and tilting movements of the elongated body during a dredging operation. In order to keep a major interior portion of the plenum chamber 23 clear of such liquid, there is provided at least one pipe section shown at 25 connected to one of the openings 24 at its upper end and extending downwardly into the plenum chamber to terminate short of the bottom as at 26. Any liquid trapped in the plenum chamber will then be blown out through the pipe 25 by the air from the gas line 15 so that the liquid level if any will always be below the lower opening 26 of the pipe 25.

Figure 5:
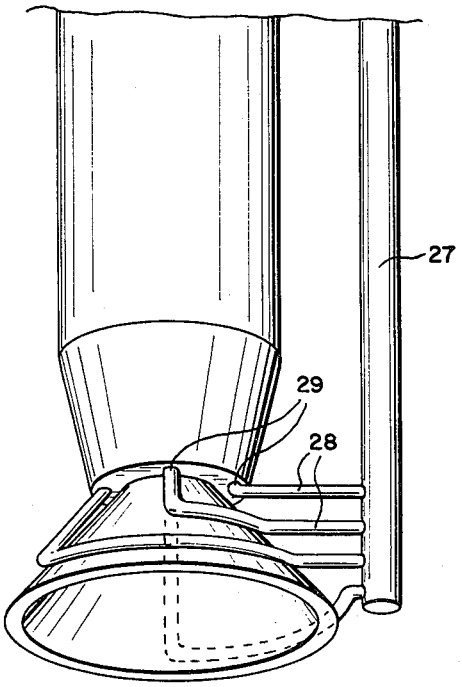
FIG. 5 is a fragmentary perspective view of a second embodiment of the invention; and, FIG. 6 is a perspective view of yet a further embodiment illustrating further features of the present invention.

FIG. 5 shows a modification of the dredging apparatus wherein rather than utilizing a plenum chamber such as at 23 described in FIGS. 2 and 3, a gas introducing means includes a modified type of gas line shown at 27 extending from the surface of the ocean to the vicinity of the dredging apparatus from which branch pipes indicated at 28 connect to various vertical openings such as indicated at 29 in the annular step. While only four such openings are schematically depicted in FIG. 5, it will be understood that there may be provided further openings connecting to individual pipes in turn connecting to the gas line 27. As in the case of the openings 24 and gas line 15 the cross sectional area of the line 27 is at least equal to the sum of the individual cross sections of the connecting pipes 28 or openings 29. An advantage of the structure described in FIG. 5 is the elimination of a plenum chamber and the attendant problem described in FIGS. 2 and 3 of possible filling of the chamber with liquid.

Figure 6:
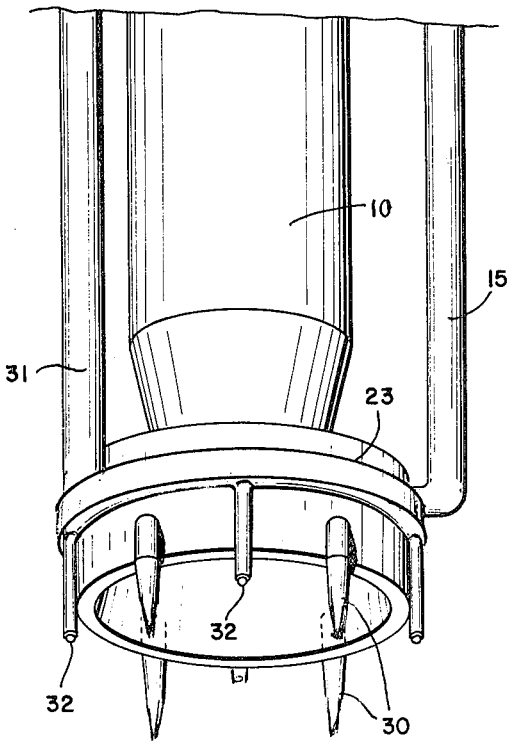

FIG. 6 shows the dredging apparatus of FIGS. 2 and 3 with further addition thereto in the form of rigid prong members 30 secured to the lower portion of the plenum chamber 23 to extend below the lower opening for engaging debris on the ocean floor and loosening the same for easy retrieval by the apparatus. In addition, there is shown in FIG. 6 a water line 31 extending from the ocean surface downwardly to the vicinity of the body 10 to which a plurality of water nozzles 32 are connected and directed downwardly in the direction of the prongs to further aid in loosening debris from the ocean floor by water jets from the nozzles.

It will be understood that in operation of any one of the embodiments described, the elongated body is caused to travel slightly above the ocean floor, the compressed gas passing up through the body providing a "air lift" which will pick up fluid and debris from the ocean floor and convey the same to the surface. As mentioned, the apparatus of this invention is particularly useful in deep ocean dredging operations such as the dredging of manganese nodules.

I claim:

1. A dredging apparatus for raising fluid and debris from the ocean floor, including, in combination:

(a) a generally vertically oriented elongated hollow body having a lower opening of a first given internal diameter decreasing in an upward direction to terminate in a throat opening of a second given internal diameter to define a venturi entrance, said throat opening immediately increasing in diameter at its exit end to a third given internal diameter to define an upwardly facing horizontal annular step lying in a plane normal to the vertical, said annular step having a plurality of vertical holes passing normally therethrough, the interior wall of said body extending upwardly from said step gradually increasing in internal diameter to an upper opening of a fourth given internal diameter to define a venturi diffuser;

(b) conveying means connected to said upper opening;

(c) means including a gas line and a plenum chamber surrounding the lower portion of said body defining said venturi entrance for introducing a flow of compressed gas from the exterior of said venturi entrance upwardly through said plurality of vertical holes in said step to said venturi diffuser to draw into said lower opening and venturi entrance, fluid and debris from the ocean floor, said step resulting in cavitation of the flow of said fluid and debris past the exit end of said throat at the step area, to result in a reduced pressure at the step surface to facilitate said flow of gas upwardly through said holes in said step, said fluid and debris passing up said conveying means and (d) at least one pipe section connected to one of said openings and extending downwardly into said plenum chamber to terminate short of the bottom of said chamber, for enabling removal of any liquid trapped in said plenum chamber.

2. A dredging apparatus according to claim 1, including a plurality of rigid prong members secured to the lower portion of said body to extend below said lower opening for engaging debris on the ocean floor and loosening the same for easy retrieval by said apparatus.

3. A dredging apparatus according to claim 2, including a water line extending from the ocean surface downwardly to the vicinity of said body; and a plurality of water nozzles connected to said water line and directed downwardly in the direction of said prongs to further aid in loosening debris from the ocean floor by water jets from said nozzles.

4. A dredging apparatus according to claim 1, wherein if D1 is said first given internal diameter, D2 said second given internal diameter, D3 said third given internal diameter, and D4 said fourth given internal diameter; and if $\alpha$ is the angle of the venturi entrance wall with respect to the vertical and $\beta$ the angle of the venturi exit wall with respect to the vertical, then:

| | |
|---|---|
| $2.0D2 \leqq D1 \leqq 2.5D2$ | $25° \leqq \alpha \leqq 35°$ and |
| $1.1D2 \leqq D3 \leqq 1.2D2$ | $5° \leqq \beta \leqq 11°$ |
| $1.4D2 \leqq D4 \leqq 1.6D2$ | |

5. A dredging apparatus according to claim 1, in which the cross sectional area of said gas line is at least equal to the sum of the individual cross-sectional areas of said plurality of holes in said annular step so that there is minimized the impedance of flow from the gas line through said holes.

* * * * *